US006780038B1

(12) United States Patent
Huang

(10) Patent No.: US 6,780,038 B1
(45) Date of Patent: Aug. 24, 2004

(54) MULTIPLE SOCKET HAVING ROTATABLE RECEPTACLES

(75) Inventor: Chyong-Yen Huang, Taipei (TW)

(73) Assignee: Atom Technology Inc. (TW)

( * ) Notice: Subject to any disclaimer, the term of this patent is extended or adjusted under 35 U.S.C. 154(b) by 0 days.

(21) Appl. No.: 10/618,006

(22) Filed: Jul. 14, 2003

(51) Int. Cl.[7] ..... H01R 27/00
(52) U.S. Cl. ..... 439/224; 439/640
(58) Field of Search ..... 439/640, 218, 439/220, 221, 222, 224, 170, 173, 1, 13, 11

(56) References Cited

U.S. PATENT DOCUMENTS 2,652,546 A * 9/1953 Christner ..... 439/8
4,671,600 A * 6/1987 Sawai et al. ..... 439/221
5,087,208 A * 2/1992 Chang ..... 439/224
6,547,578 B2 * 4/2003 Huang ..... 439/222

* cited by examiner

*Primary Examiner*—Neil Abrams

(57) ABSTRACT

A multiple socket having rotatable receptacles includes a plurality of sets of receptacles at a housing of the multiple socket, and a first conducting strap and a second conducting strap at an interior of the housing. At positions corresponding to positions of the receptacles, the first conducting strap and the second conducting strap are provided with clamping portions for inserting with pins of plugs. At least one set of receptacles is disposed at the housing in a rotatable manner, and the receptacles are provided with insertion openings at positions corresponding to the clamping portions. When the receptacles rotate pivotally, the insertion openings are rotated regard the clamping portions as rotation axes thereof, such that regardless of directions of the receptacles pivotally rotated, the pins of the plugs are penetrated in these specific directions through the insertion openings to come into contact with the clamping portions.

1 Claim, 5 Drawing Sheets

MULTIPLE SOCKET HAVING ROTATABLE RECEPTACLES

BACKGROUND OF THE INVENTION (a) Field of the Invention

The invention relates to a multiple socket having rotatable receptacles, and more particularly, to a multiple socket having rotatable receptacles, wherein adjacent plugs inserted at the multiple socket can be staggered without interfering with one another by rotating and adjusting directions of the receptacles.

(b) Description of the Prior Art

A common multiple socket is formed by disposing a plurality of sets of receptacles at a housing thereof. The receptacles are disposed with equal distances in between, and can be inserted by several plugs having normal sizes. However, when the receptacles are inserted by specific plugs, or plugs of adaptors having larger volumes, one single specific plug or a plug of an adaptor having a large volume frequently occupies space of two adjacent receptacles. Therefore, the concealed receptacles are considered idle and cannot be used. In addition, such type of conventional multiple socket has invariable directions for inserting plugs, with the directions either being vertical or horizontal. Hence, the multiple socket fails to provide adjustable directions for plugs inserted, and is hardly ideal when put to use.

SUMMARY OF THE INVENTION

The primary object of the invention is to provide a multiple socket having rotatable receptacles, such that when plugs having various sizes are inserted therein, adjacent plugs are inserted in a staggered arrangement without interfering with one another by rotating and adjusting inserting directions of the receptacles of the multiple socket.

The multiple socket having a plurality of sets of receptacles according to the invention comprises a housing, and a first conducting strap and a second conducting strap provided in the housing. At positions corresponding to positions of the receptacles, the first conducting strap and the second conducting strap are provided with clamping portions for inserting pins of plugs. The characteristics of the invention are that, at least one set of receptacles is disposed at the housing in a rotatable fashion, and a base plane of the receptacles is provided with insertion openings corresponding to the clamping portions for inserting with pins of plugs; and when the receptacles rotate pivotally, the insertion openings are rotated regarding the clamping portions as rotation axes thereof, such that regardless of directions of the receptacles pivotally rotated, the pins of the plugs are penetrated in these specific directions through the insertion openings to come into contact with the clamping portions.

DETAILED DESCRIPTION OF THE PREFERRED EMBODIMENTS

To better understand the invention, detailed descriptions shall be given with the accompanying drawings hereunder.

Figure 1:
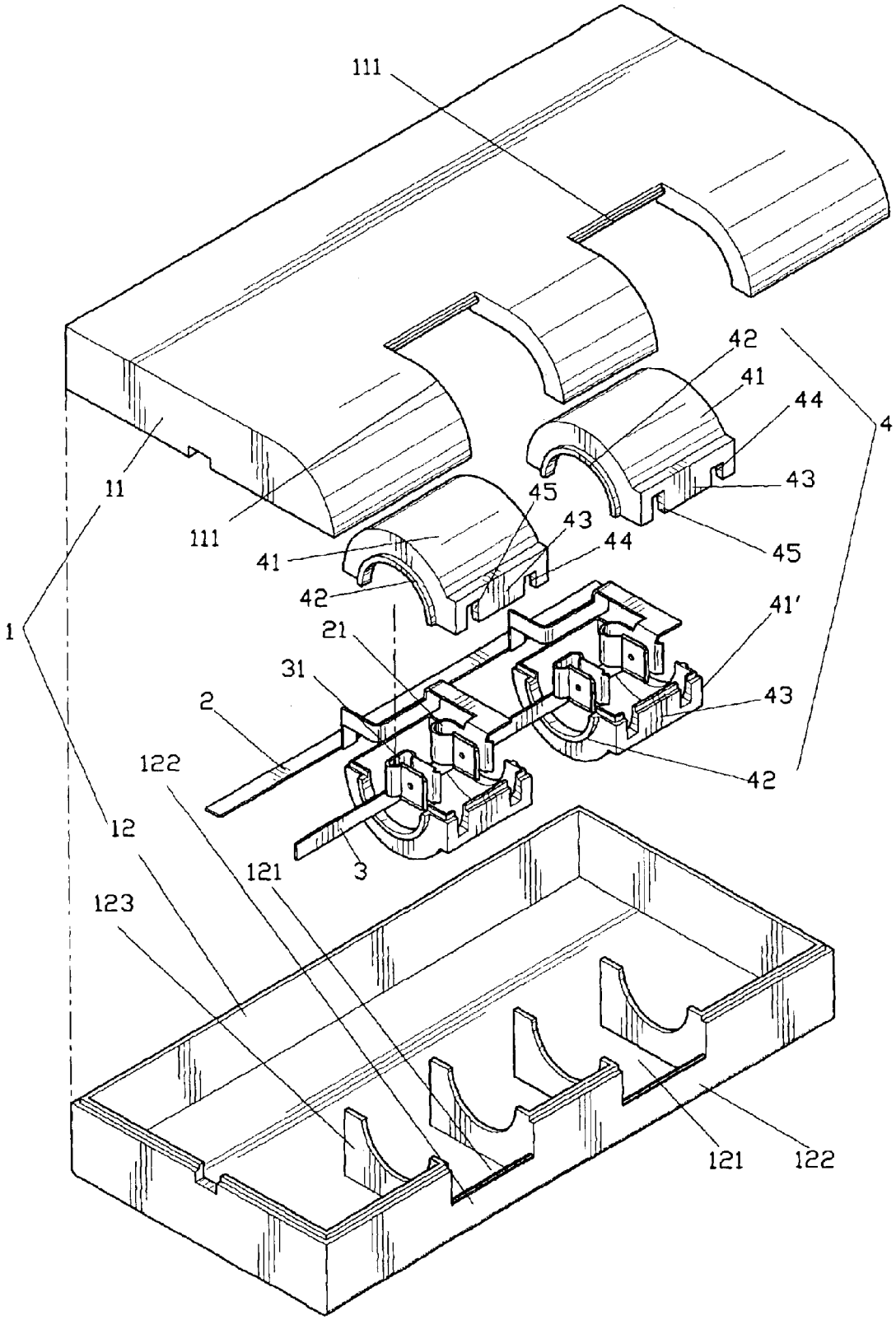
FIG. 1 shows a structural schematic view according to the invention.

Referring to FIG. 1 showing a first embodiment according to the invention, a multiple socket comprises a housing 1, a first conducting strap 2 and a second conducting strap 3 disposed in the housing 1, and a plurality of sets of receptacles 4 disposed at the housing 1.

The housing 1 is consisted of upper and lower housings 11 and 12 having notches 111 and 121 at side edges thereof. When the upper and lower housings 11 and 12 are joined, the notches 111 and 121 form pivotal openings for accommodating the receptacles 4. The notches 121 of the lower housing 12 have perpendicular stopping walls 122 at side edges thereof, and retaining pieces. 123 extended from two sides thereof. An interior of the housing 1 has the first conducting strap 2 connected with an external power live line, and the second conducting strap 3 connected with an external power ground line. The first conducting strap 2 and the second conducting strap 3 further have clamping portions 21 and 31 corresponding to positions of the receptacles 4.

The receptacles 4 are consisted of upper and lower casings 41 and 41'. The upper and lower casings 41 and 41' each has protruding pivotal axes 42 at two sides thereof, respectively, and a straight insertion flatbed 43 at a base plane thereof. The insertion flatbed 43 is provided with insertion openings 44 and 45 corresponding the extended directions of the clamping portions 21 and 31 of the first conducting strap 2 and the second conducting strap 3.

Figure 2:
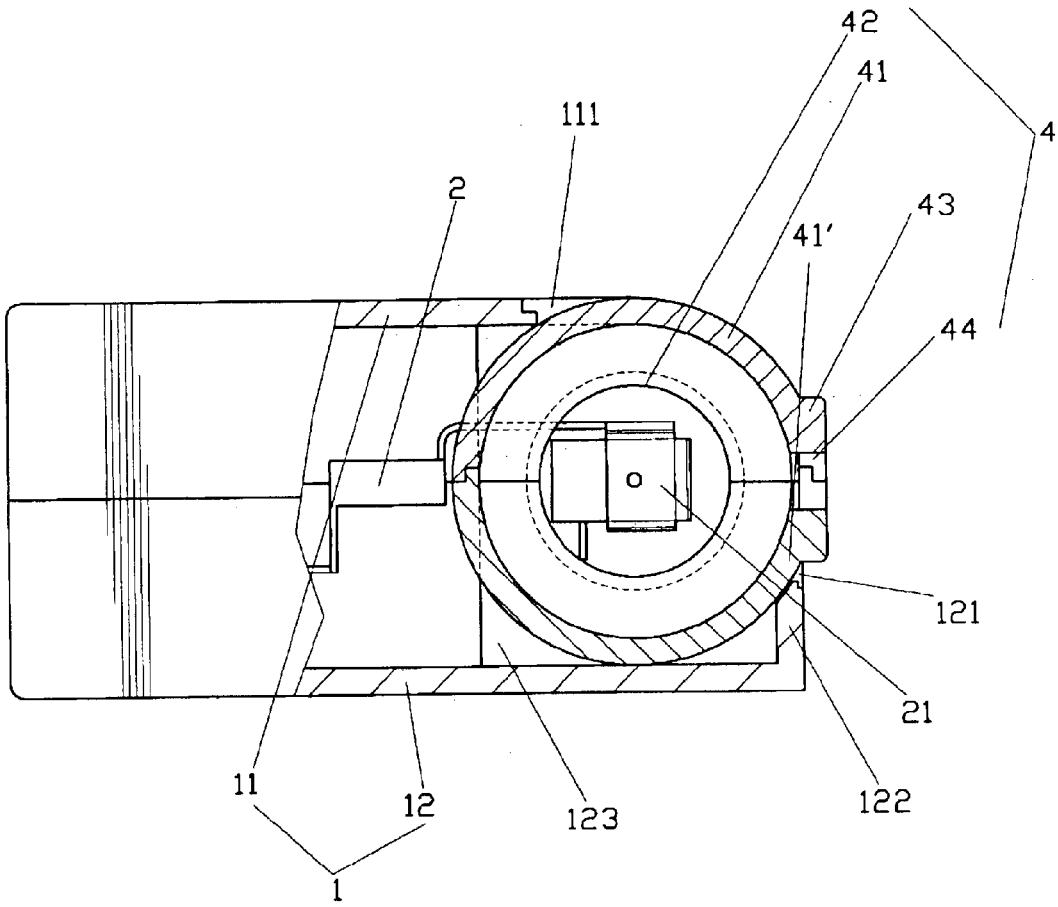
FIG. 2 shows a schematic view according to the invention.

For assembly, referring to the FIGS. 1 and 2, the lower casing 41' of the receptacles 4 is placed on the retaining pieces 123 of the lower housing 12 using the pivotal axes 42. The first conducting strap 2 and the second conducting strap 3 are fastened in the lower housing 12 (flanges required for fastening the first conducting strap 2 and the second conducting strap 3 are omitted in the diagram). The clamping portions 21 and 31 of the first conducting strap 2 and the second conducting strap 3 are aligned with the insertion openings 44 and 45 of the receptacles 4. The upper casing 41 of the receptacles 4 is correspondingly covered onto the lower casing 41', and the upper housing 11 of the housing 1 is correspondingly covered onto the lower housing 12, thereby enclosing the receptacles 4 in the housing 1. After assembly, an edge of the flatbed 43 is butted against side edges of the notches 111 and 121. When the receptacles 4 rotate pivotally, the side edge of the flatbed 43 forms a limiting position of rotation through the stopping walls 122 at the sides of the notches 111 and 121, thereby enabling the receptacles 4 to pivotally rotate by 90 degrees. When the receptacles 4 rotate pivotally, the insertion openings 44 and 45 are rotated regarding the clamping portions 21 and 31 as rotation axes thereof. Hence, the insertion openings 44 and 45 are relatively positioned with the clamping portions 21 and 31 regardless of positions of the receptacles 4 pivotally rotated.

Figure 3:
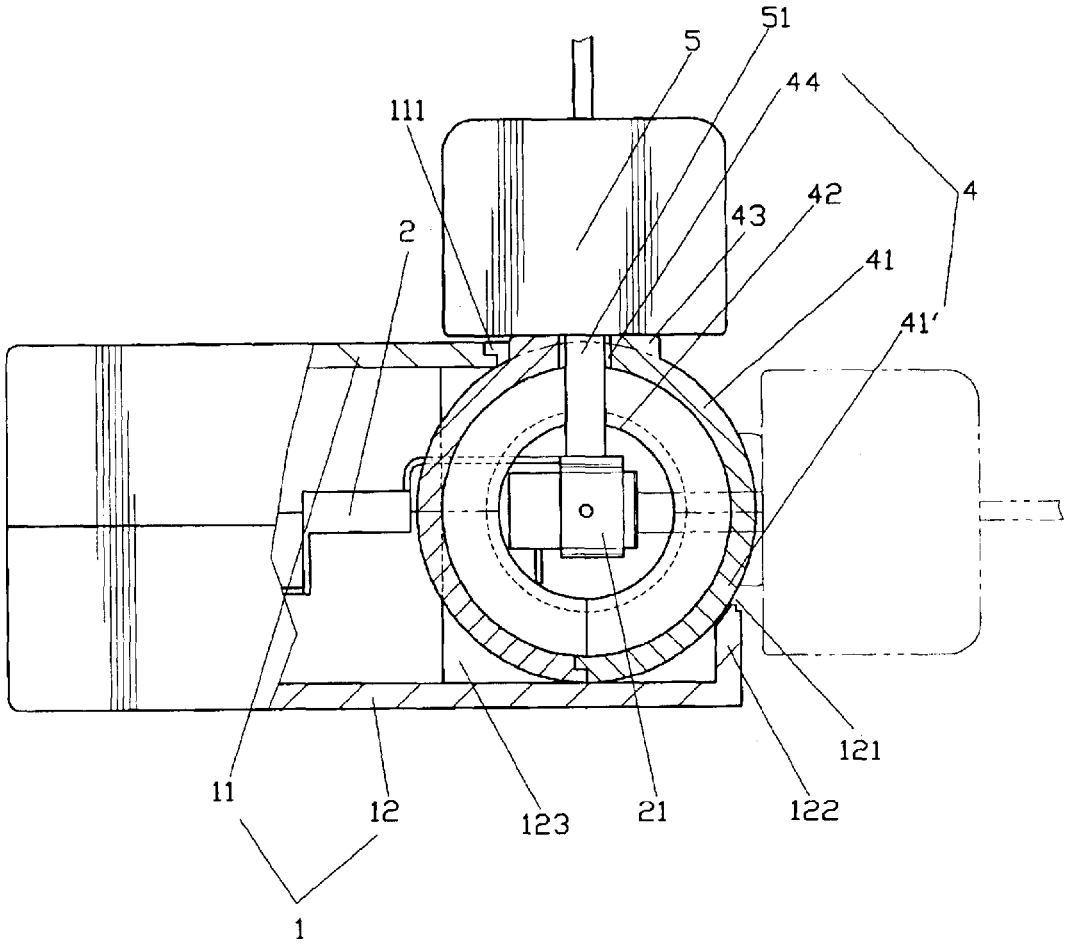
FIG. 3 shows a view of a completed structure in an embodiment according to the invention.

Referring to FIG. 3 showing an implementation of an embodiment according to the invention, the receptacles 4 are axially and pivotally rotated at the notches 111 and 121 of the housing 1, so as to adjust the flatbed 43 to an appropriate position. After passing through the flatbed 43, pins 51 of a plug 5 are inserted into the insertion openings 44 and 45 to come into contact with the clamping portions 21 and 31 of the first conducting strap 2 and the second conducting strap 3. When a plug 5 having a larger volume is inserted, using a characteristic as being pivotally rotatable of the receptacles 4, adjacent plugs 5 can be inserted in a staggered arrangement without interfering one another. Therefore, each set of receptacles can be utilized, and occupancy of unused receptacles by adjacent plugs is not incurred.

Figure 4:
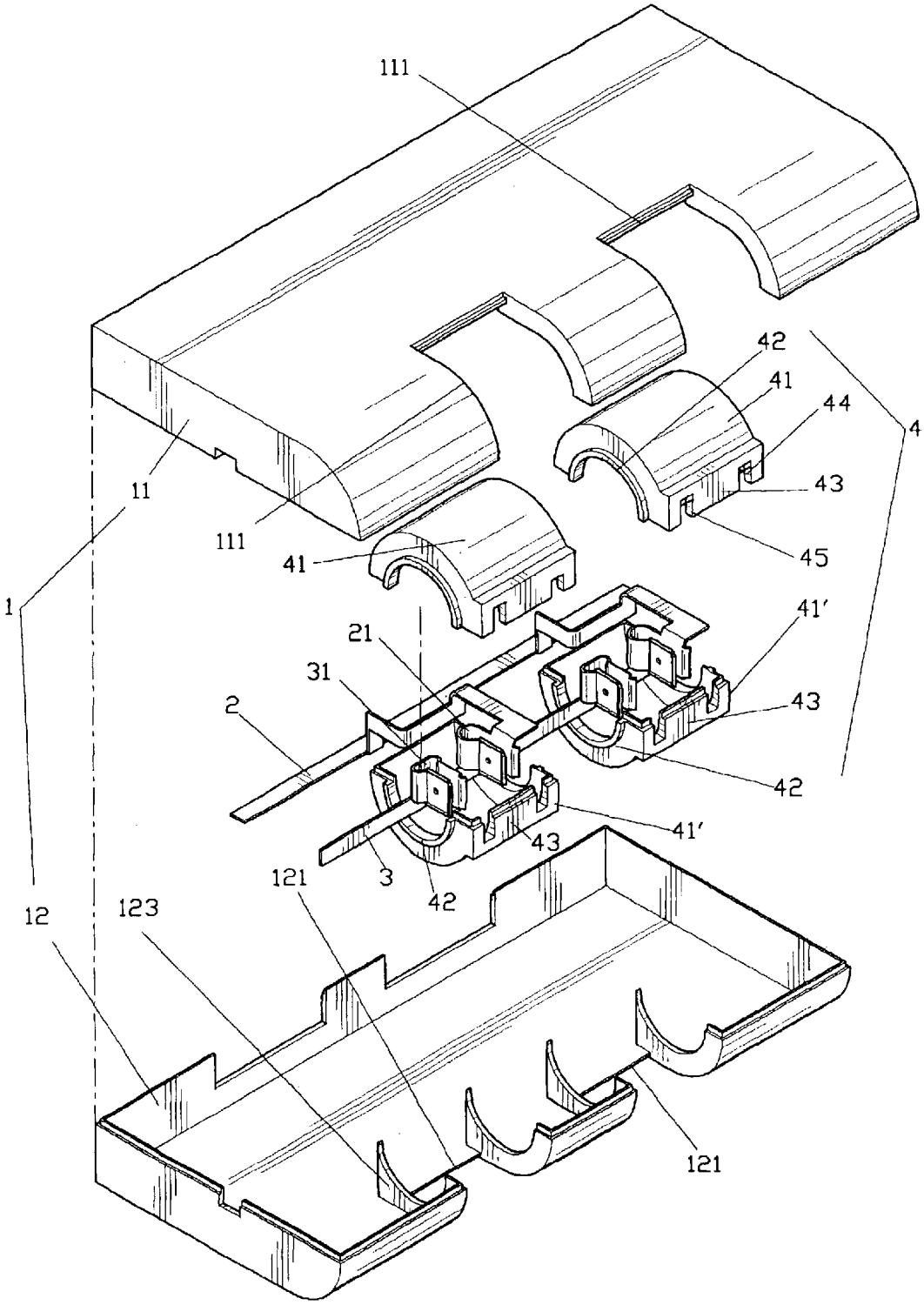
FIG. 4 shows a schematic view of another embodiment according to the invention.
Figure 5:
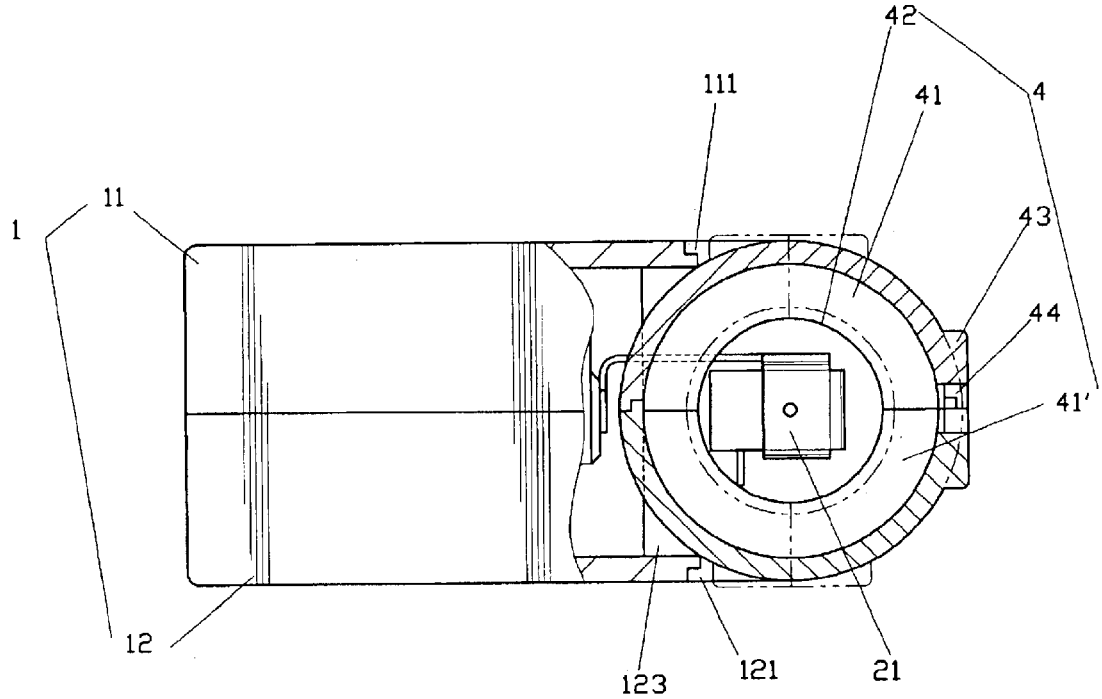
FIG. 5 shows a schematic view of a completed structure in another embodiment according to the invention.

Referring to FIGS. 4 and 5, the receptacles 4 according to the invention can be rotated at an enlarged angle of 180 degrees. In an embodiment shown in FIGS. 4 and 5, the housing 1 similarly has the first conducting strap 2, the second conducting strap 3 and the receptacles 4. However, the upper and lower notches 111 and 121 at the housing 1 are provided symmetrically in an open manner, so as to freely rotate the receptacles 4 within 180 degrees in the notches 111 and 121, and to enable the flatbed 43 to face different directions. Similarly, during pivotal rotations of the receptacles 4, the insertion openings 44 and 45 also regard the clamping portions 21 and 31 of the first conducting strap 2 and the second conducting strap 3 as rotation axes thereof. Hence, the insertion openings 44 and 45 are relatively positioned with the clamping portions 21 and 31 regardless of positions of the receptacles 4 pivotally rotated.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A multiple socket comprising:

a housing having receptacles, and a first conducting strap and a second conducting strap provided in the housing; wherein at positions corresponding to positions of the receptacles, the first conducting strap and the second conducting strap are provided with clamping portions for inserting pins of plugs; and the characteristics thereof being that, the receptacles are disposed at the housing in a rotatable manner, and a base plane of the receptacles is provided with insertion openings corresponding to the clamping portions for inserting with pins of plugs; and when the receptacles rotate pivotally, the insertion openings are rotated regarding the clamping portions as rotation axes thereof, such that regardless of directions of the receptacles pivotally rotated, the pins of the plugs are penetrated in these specific directions through the insertion openings to come into contact with the clamping portions.

* * * * *